US006089685A

United States Patent [19]

Ryan et al.

[11] Patent Number: 6,089,685

[45] Date of Patent: Jul. 18, 2000

[54] STORAGE CABINET WITH SELECTIVELY MOUNTED INDEPENDENTLY SUPPORTED SHELVES

[75] Inventors: Thomas Ryan, Del Mar; Jon Forbes, La Palma; James McCarthy, Laguna Niguel; Brad Amano, Huntington Beach, all of Calif.

[73] Assignee: Jensen Industries, Los Angeles, Calif.

[21] Appl. No.: 09/292,513

[22] Filed: Apr. 15, 1999

[51] Int. Cl.[7] ..... A47B 96/00

[52] U.S. Cl. ..... 312/351; 312/291

[58] Field of Search ..... 312/350, 351, 312/245, 242, 207, 408, 238, 265.6; 211/189, 186, 187, 198

[56] References Cited

U.S. PATENT DOCUMENTS

| | | | |
|---|---|---|---|
| 3,185,534 | 5/1965 | Peters, Jr. | 312/291 |
| 3,298,764 | 1/1967 | Goldfarb . | |
| 3,306,689 | 2/1967 | Isaacson et al. | 312/351 |
| 4,134,625 | 1/1979 | Palka . | |
| 5,255,971 | 10/1993 | Aisley . | |
| 5,405,196 | 4/1995 | Shoup et al. | 312/351 |
| 5,484,196 | 1/1996 | Kim . | |
| 5,524,980 | 6/1996 | Carter et al. . | |

FOREIGN PATENT DOCUMENTS

| | | |
|---|---|---|
| 1219941 | 4/1959 | France . |

*Primary Examiner*—José V. Chen
*Assistant Examiner*—Jerry A. Anderson
*Attorney, Agent, or Firm*—Baker & Maxham

[57] ABSTRACT

A storage cabinet, comprises a generally rectangular open front housing having a rear wall joined to a top wall, bottom wall, and side walls, a plurality of mounting grooves, each groove extending horizontally along the inside back wall and side walls of the housing, a plurality of storage units having mounting edges adapted to be selectively mounted in the housing in selected ones of the mounting grooves, wherein at least one of the storage units having a width less than the full width of the interior of the housing, at least one latching device for latching each of the storage units in one of the mounting grooves, wherein at least one of the storage units is supported solely by the storage unit mounting edges engaging one of the mounting grooves along a portion of the back wall and one of the side walls.

27 Claims, 5 Drawing Sheets

STORAGE CABINET WITH SELECTIVELY MOUNTED INDEPENDENTLY SUPPORTED SHELVES

BACKGROUND OF THE INVENTION

1. Field of the Invention

The present invention relates generally to storage cabinets such as utility cabinets and medicine cabinets of the type used in residential dwellings and the like to store food, kitchen ware, personal belongings, medicines, toiletries, and a variety of household and other belongings. More particularly, this invention relates to an improved cabinet construction providing an adjustable internal cabinet configuration with a highly versatile shelf and storage unit geometry, various interchangeable storage units including drawers.

2. Discussion of the Related Art

Divided cabinets are known for use in storing a variety of items in residential dwellings. Traditional cabinets have commonly comprised a forwardly open cabinet housing constructed to fit into or onto the wall of a residence. They are typically permanently installed during residence construction and only refinished, refurbished, or replaced at notable expense to the owner. Examples of such cabinets can be found in residential kitchens, bedrooms, garages, and bathrooms. For instance, the traditional medicine cabinet or bath storage cabinet is a simple enclosed shell or body made from steel, plastic or aluminum with a hinged door. A mirror is usually attached to the exterior of the door for grooming and a magnetic or friction spring catch is used to hold the door in the closed position. The interior of the cabinet generally contains several full width shelves that most often can be adjusted up or down to fit the storage needs of the user. Some bath cabinets, however, only offer a number of fixed, non-adjustable shelves. Nearly all bath cabinets are designed for permanent installation. While some cabinets are designed to be installed with the body itself recessed into a hollow wall, others allow the cabinet to be mounted on the surface of the wall.

Although medicine cabinets of the above-described general type have been well-known for many years, the traditional cabinet construction incorporates a variety of inherent limitations and disadvantages. As an example, while some cabinet designs have some adjustable selection of shelf position, but these have generally been limited to an array of shelves spanning the full width of the cabinet interior. For instance, many of the medicine cabinets being sold today have only three shelves for storing toilet articles. Accordingly, when one or more relatively tall articles such as a bottle of mouthwash or the like is to be stored within the cabinet, it must be provided with an entire shelf in order to have sufficient clearance to accept the tall bottle. This unfortunately results in a significant waste of space within the medicine cabinet, since the user rarely has a sufficient number of tall bottles to occupy an entire shelf width.

In order to increase the utility of storage and medicine cabinets, various designs have been proposed. One such newly designed cabinet is shown in Aisley U.S. Pat. No. 5,255,971, which discloses a medicine cabinet having preformed grooves therein which cooperate with one or more upright central shelf support partition or brackets to support an array of half width shelf members in a customized geometry of half and full width shelves. This cabinet is constructed predominately of molded plastic components. While this cabinet does propose some improvements that would be helpful, it uses a vertical central support bracket to support its shelves. This vertical support partition splits the adjustable interior shelves in half limiting the users ability to optimize, tailor, and customize the cabinet storage and shelving capability.

Another device designed to increase the utility of medicine cabinets is shown in Carter et al. U.S. Pat. No. 5,524,980, which discloses an insert designed to fit a standard medicine cabinet body and provide flexible shelving options Once installed into an existing medicine cabinet this medicine cabinet organizing insert creates a more efficient use of the space available by using a vertical divider in its rectangular frame to divide the organizing insert into two vertical compartments. The insert divides the cabinet into unequal storage spaces with one side having a plurality of adjustable shelves. As in the Aisley device, the necessity of this vertical partition limits the users ability to optimize, tailor, and customize the cabinet storage and shelving capability.

U.S. Pat. No. 5,484,196 of Kim discloses a cabinet wherein half shelves have a built-in bracket on one end with a hook which engages a vertical slot in the middle of the back wall off the cabinet to support one end of the shelf.

A cabinet with a vertical partition limits the users ability to store long or large objects. For instance storing a curling iron would require the impractical technique of standing the iron up on end in a shelf tall enough to accept its length. Similarly, it would not be possible to store a large or odd shaped item such a blow dryer in a divided cabinet. Further, these designs do not incorporate the safety features of a drawer with a child resistant lock. Nor do they include independently supported shelves or storage units. Failure of the vertical support partition or a severe jar may cause the contents of every shelf to be dumped out of the front of a cabinet that does not use independently supported storage units. Finally, the above designs do not include shelves with pockets for storing toothbrushes and shaving razors, or pockets for storing the power cords for electronic razors, curling irons, blow dryers, or other electronic bathroom items.

There exists, therefore, a significant need for improvements in the design and construction of a storage cabinet, particularly with respect to improved storage space customization and versatility through the arrangement of adjustable shelves and storage units that are independently supportable without a central vertical partition. It is therefore desirable to have an improved cabinet construction providing a highly adjustable internal cabinet shelf and storage unit geometry, various inter-changeable storage units including drawers with child resistant locking mechanisms and shelves, an improved door hinge assembly, and an improved door latching mechanism. The present invention fulfills all of these needs and provides further related advantages.

SUMMARY AND OBJECTS OF THE INVENTION

It is a primary object of the present invention to provide an improved storage cabinet having improved storage space customization and versatility through the arrangement of adjustable shelves and storage units that are independently supportable without a vertical partition.

It is another object of the present invention to provide an improved an improved cabinet construction providing a highly adjustable internal cabinet shelf and storage unit geometry, various interchangeable storage units including drawers with child resistant locking mechanisms and shelves, an improved door hinge assembly, and an improved door latching mechanism.

In accordance with a primary aspect of the present invention, a storage cabinet comprises a generally rectangular open front housing having a rear wall joined to a top wall, bottom wall, and side walls, a plurality of mounting grooves, each groove extending horizontally along the inside back wall and side wall of said housing, a plurality of storage units having mounting edges adapted to be selectively mounted in said housing in selected ones of said mounting grooves, wherein at least one of said storage units having a width less than the full width of the interior of said housing, at least one latching device for latching each of said storage units in one of said mounting grooves, wherein at least one of said storage units is supported solely by said storage unit mounting edges engaging one of said mounting grooves along a portion of said back wall and one of said side walls.

BRIEF DESCRIPTION OF THE DRAWINGS

The nature, goals, and advantages of the invention will become more apparent to those skilled in the art after considering the following detailed description when read in connection with the accompanying drawing—illustrating by way of examples the principles of the invention—in which like reference numerals identify like elements throughout, wherein.

DETAILED DESCRIPTION OF A PREFERRED EMBODIMENT

Figure 1:
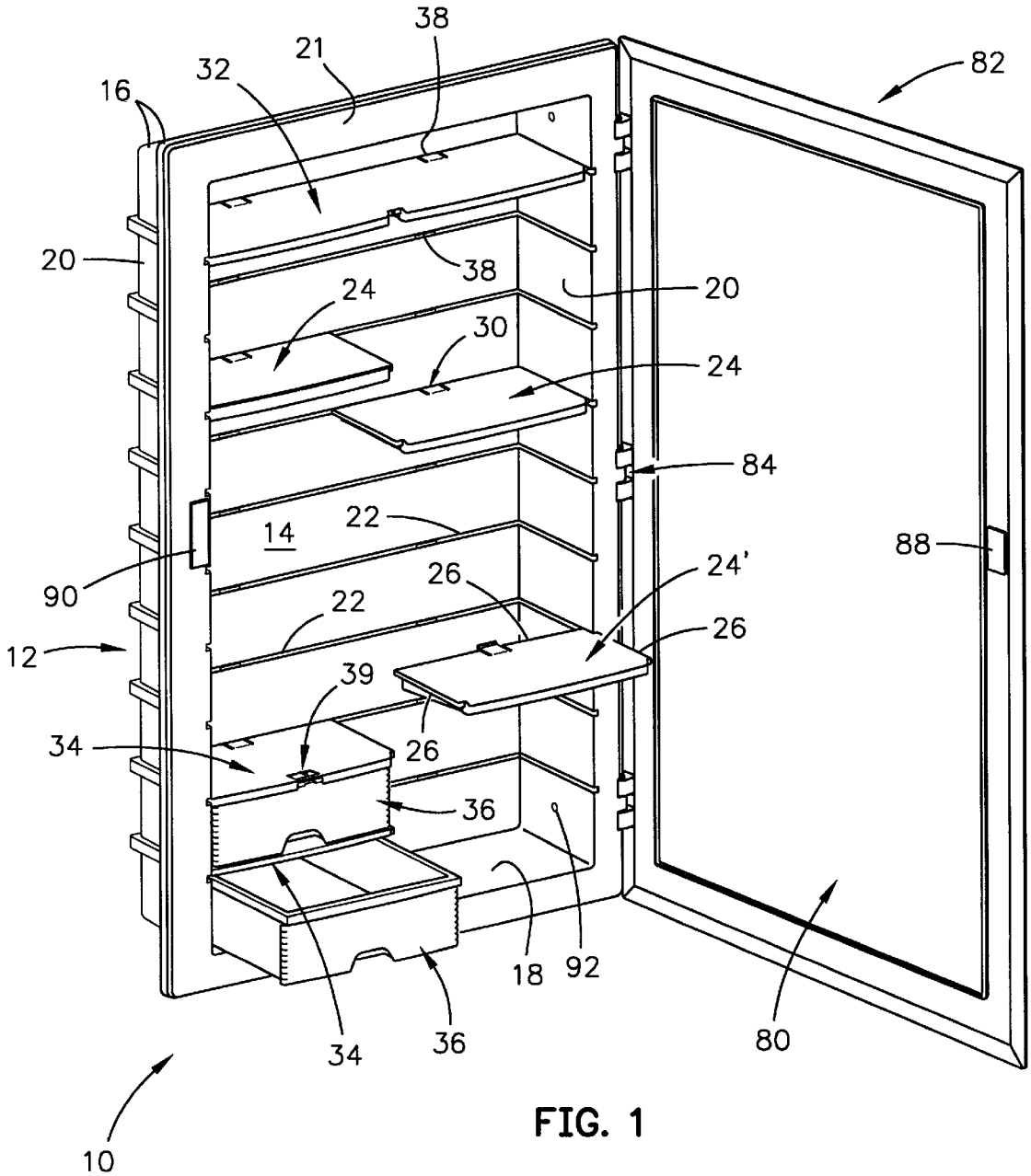
FIG. 1 is a perspective view of the front of the storage cabinet with the door open, showing the horizontal mounting grooves and a typical storage unit installation.
Figure 2:
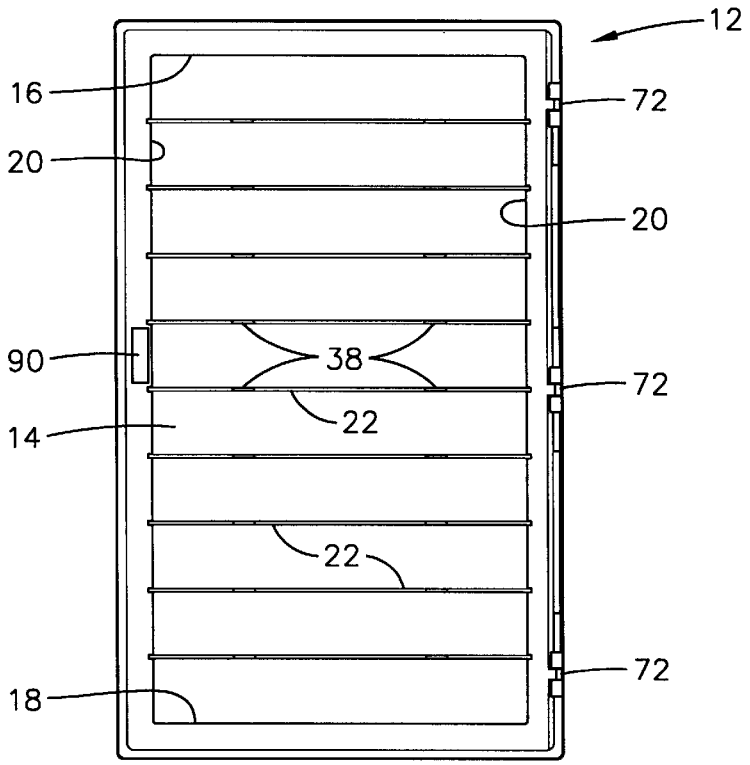
FIG. 2 is a front elevation view of the storage cabinet housing of FIG. 1 showing the internal horizontal mounting grooves and the door hinge mounts.
Figure 4:
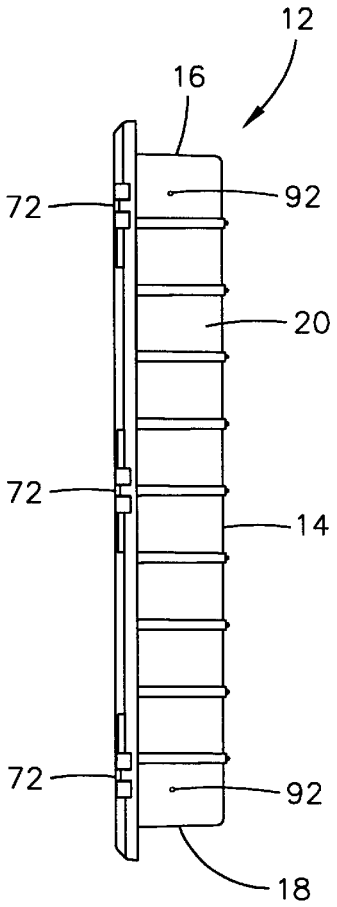
FIG. 4 is a side elevation view of the storage cabinet housing in FIG. 1, without a door, showing the hinge mounts and holes for securing the cabinet within a wall.
Figure 3:
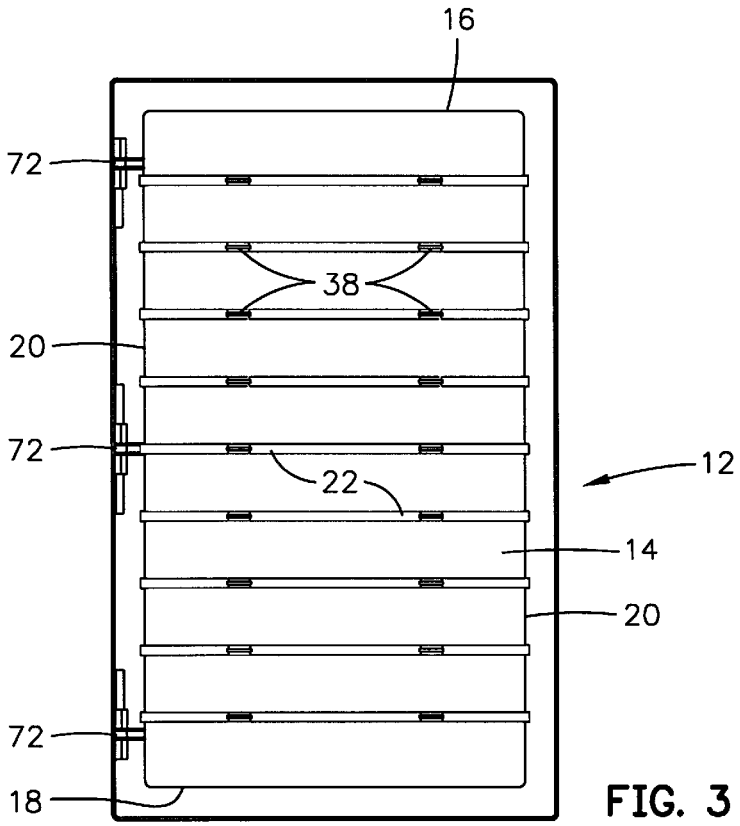
FIG. 3 is a back elevation view of the storage cabinet housing of FIG. 1, showing the exterior of the housing and one embodiment of the housing components of the latching devices.

The present invention solves the problem of a cabinet user having a limited ability to optimize, tailor, and customize cabinet storage and shelving capability due to interior shelf support brackets. The present invention provides adjustable, independently supportable storage units and shelves which do not require vertical partitions, and allow more different size items to be stored in the cabinet.

Broadly, the present invention provides an improved cabinet construction including an adjustable internal cabinet configuration with a highly versatile shelf and storage unit geometry, various interchangeable storage units. More specifically, one embodiment of the invention provides an improved cabinet construction with a storage geometry adjustable within the confines of the cabinet housing, a selection of variously-sized independently supportable interchangeable storage units including drawers with child resistant locking mechanisms and shelves, an improved door hinge assembly, and an improved door latching mechanism. A plurality of mounting grooves extend horizontally along the inside back wall and side wall of the housing for mounting storage units. A plurality of storage units having mounting edges adapted to be selectively mounted in the housing are mounted in selected mounting grooves. At least one of the storage units has a width less than the full width of the interior of said housing. At least one latching device is provided for latching each of the storage units in one of the mounting grooves. At least one of the storage units is supported solely by the storage unit mounting edges engaging one of the mounting grooves along a portion of the back wail and one of the side walls of the cabinet.

The present invention is designed to adequately and safely support less than full width shelves and storage units without vertical interior walls and support brackets of the prior art. This enhances the flexibility and customization of the storage space inside without limiting the width of storage shelves or units that may be installed. A storage cabinet according to the invention provides storage units supported by engaging a portion of the back wall and one of the side walls of the cabinet, without need for a vertical partition and support brackets. Accordingly, the present invention provides a more versatile structure for storing articles of odd shapes. Therefore, it is possible to customize space to store more items by designing the interior of the cabinet to fit the specific products the user desires. The storage cabinet is simple and easily fabricated using molded plastic or other materials.

The invention affords its users with a number of distinct advantages. First, unlike prior cabinet designs which either had only full length shelves or had a vertical central support bracket or a vertical divider which partitioned the adjustable interior shelves in half, the present invention has none of these limitations on its ability to provide a variety of shaped storage spaces and capabilities within the confines of its housing. As shown in the drawings for purposes of illustration, the invention is embodied in a storage cabinet providing independently supported shelf and storage units that may be selectively placed within the cabinet. A cabinet according to the invention allows a user to specifically tailor storage space and units within the cabinet as desired by customizing selection and placement of differently types of independently supported storage units and shelves without the need for a vertical support partition. Existing cabinets and cabinet inserts have not been able to provide the flexibility of independently supported storage units and shelves or the versatility of full cabinet width storage space.

Referring to the drawings wherein like elements are identified with like reference numerals, an exemplary embodiment of an improved storage cabinet in accordance with one embodiment of the invention is illustrated in FIG. 1 and is designated generally by the numeral 10. As illustrated, the invention provides an improved cabinet construction with a storage geometry adjustable within the confines of a cabinet housing 12, wherein a selection of variously sized independently supportable interchangeable storage units designated generally by the numerals 24, 24', 32, 34, 36 and 40 respectively are selectively mounted. These include a pair of half shelves 24 shown in separate mounting grooves or slots 22 or slots and on opposite sides of the housing. Another embodiment of a half shelf 24' is illustrated in the lower right side of the cabinet. This shelf unit is provided with modified reinforcing ribs as will be described and is more fully illustrated in FIG. 12. A full width shelf designated generally by the numeral 32 is shown mounted in the uppermost mounting groove. A pair of drawer shelves 36 with drawer units 40, and 40' are shown mounted in the lower left hand side of the housing. These storage units are provided with a tongue like mounting edge 26 along the back and end edges that fits snugly into grooves 22. A latch tab 30 has a tab that cooperates with a latch slot or recess in the slots 22 for securing the units in place in the mounting grooves. One of the drawer units 40 is shown equipped with a child-resistant locking mechanism shown generally at 39.

The storage cabinet 10 as shown in FIGS. 1–4 comprises a generally rectangular open front housing 12 with a rear wall 14 joined to a top wall 16, bottom wall 18, and side walls 20 with a generally rectangular front frame or face 21. The housing as shown is of a generally unitary construction and may be constructed by molding or other means of any number of suitable materials such as metal, plastic, aluminum, wood, or any other material or combination capable of supporting the design. In the preferred embodiment, the housing is molded of polystyrene using high pressure injection molding. Other components which fit together are preferably made of different materials such as polypropylene and ABS. In other embodiments, the housing may be manufactured using any other suitable means including stamping, molding, carving, shaping, assembly of distinct components, and/or any other viable commercial process Further embodiments include a housing constructed by assembling components manufactured using a variety of methods. In an alternate embodiment, parts of the housing 12 and storage units 24, 24', 32, 34, 36 or 40 are constructed of materials selected to reduce friction and wear on housing and storage unit components. The housing is preferably constructed of an easy to clean material such as material selected to minimizes static electricity buildup, thereby minimizing dust residue in the cabinet. In addition, parts of the housing 12 and some of the storage units may be constructed of materials such as nylon selected to reduce friction and wear on housing and storage unit components.

The interior of the housing is formed with a plurality of vertically spaced mounting grooves 22 extending horizontally along the inside back wall and side walls of the housing for receiving and mounting storage units. In the preferred embodiment, the housing is made by injection molding and the mounting grooves 22 are formed in the housing during the injection molding process. Alternatively, the mounting grooves can be cut into the housing or formed by any other suitable means during manufacturing of the housing or post manufacturing method. The storage units 24, 24',32, 34, 36 and 40 are each formed with mounting edges 26 adapted to be selectively inserted into selected mounting grooves 22 for mounting the storage units. Each storage unit mounting edge is provided with at least one latching device 30 including a tab and each mounting groove is provide\d with a latching slot for receiving the tab for latching each of the storage units into the respective one of the mounting grooves. The mounting grooves 22 preferably have a deep rectangular profile (FIGS. 8 and 9), however, any design capable of sufficiently supporting storage units and their contents is acceptable. The mounting groove and mounting edge form a tongue and groove type joint.

As seen in FIG. 1, several of the storage units 24, 24', 34 have a width less than the full width of the interior of the housing. These storage units form shelves which are supported solely by the storage unit mounting edges engaging one of the mounting grooves along a portion of the back wall and one of the side walls of the cabinet. They are securely retained in the grooves by the latch assembly 30. The shelf units have the tongue or flange member on both ends and the back and are capable of being mounted on either the left or right side of the housing and that can be mounted on the same mounting groove, spanning the full cabinet width. The shelf units 24, 24', 34 are constructed to be sufficiently rigid that they are self supporting without support brackets. The shelves are stiffened by peripheral and cross ribbing as will be explained and illustrated in FIG. 10. Since there is no need for a vertical partition or central bracket, the storage units may have a variety of widths less than the full width of the interior of the housing in any selected groove. The mounting edges of the full width storage units engage mounting grooves along the back wall as well as both side walls. Additional types of storage units include a shelf 34 with rails or tracks underneath to which a drawer 36' may be slidably mounted.

The versatility of storage space and flexibility of available storage units is illustrated in the specific embodiment of FIG. 1 where the storage units installed include those 32 spanning the fill cabinet width, as well as half width storage units supported solely by their mounting edges engaging a portion of the back wall and one of the side wall mounting grooves (24, 24', 34, 36, or 40). A cabinet can be equipped solely with one or any combination of the storage units. Thus, it can have all full-length shelves, all less than full-length or any combination thereof In the preferred embodiment, the housing is manufactured using high injection molding. In other embodiments, the housing may be manufactured using any other suitable means including stamping, molding, carving, shaping, assembly of distinct components, and/or any other viable commercial process. Further embodiments include a housing constructed by assembling components manufactured using a variety of methods. In an alternate embodiment, parts of the housing 12 and storage units 24, 32, 34, 36 or 40 are constructed of materials selected to reduce friction and wear on housing and storage unit components.

As shown in FIG. 1, selectively mounted within the storage cabinet housing 12 are variously sized independently supportable interchangeable storage units 24, 24', 32, 34, 36 and 40 picked out by the user for setting articles on or storing articles within. An extensive variety of storage units may be chosen from for installation into the cabinet. Those illustrated as 24, 24', 32, 34, 36 and 40 are just a few examples. This variety of storage unit types and sizes, and flexibility of placement options, affords the user the opportunity to customize the size and shape of available cabinet storage space as illustrated in FIG. 1.

For instance, it is possible to mount storage units with various widths, sizing from a very narrow shelf which might have a single hole in it to support a toothbrush to a full cabinet width shelf 32 capable of holding numerous items (FIGS. 1). Alternatively, half width storage units may be mounted on only one side of the housing as shown in FIG. 1 by 24, 34, 36, or quarter width units may be mounted on both sides of the housing, affording the user a column of space for storing items as tall as the cabinet interior. Optionally, full width storage units may be mounted on only a few of the top and bottom mounting grooves, affording the user a space for storing items as wide as the cabinet interior The storage units are formed with a mounting tongue or lip on the back and both ends and are capable of being installed on either the left or right side of the housing.

Figure 10:
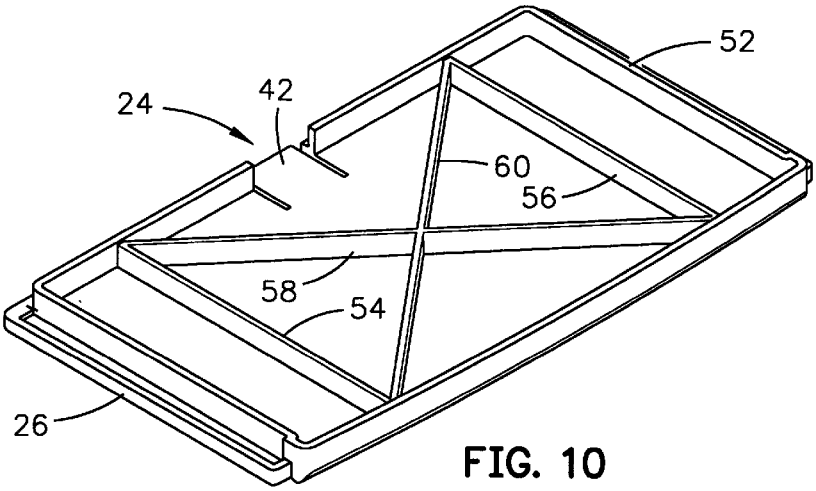
FIG. 10 is a perspective bottom view of a shelf unit showing reinforcing rib construction.

As shown best in FIGS. 1 and 10, one typical type of storage unit is a shelf 24 having a mounting tongue 26 for mounting in a mounting slot 22 along part of the back wall 14 and a side wall 20. The shelf has a latching device including a tab in the mounting grooves. The shelf can be mounted along either side of the cabinet housing, and two shelves with complimentary width equal to that of the housing interior may be mounted side by side, spanning the entire housing and functioning as a single full width shelf. A shelf may also incorporate side edges and or ribbing that is thicker or taller toward the back edge of the shelf and tappers becoming thinner or shorter towards the front edge for the shelf for additional stiffness and support.

The user also has the option of installing less than full width shelves, including half width, quarter width, and very narrow shelves. FIG. 1 is a good illustration of a typical installation including half width shelves 24. If a large cabinet column shaped space spanning the full height and half the full width of the cabinet is needed, the user can install half width shelves on only one side of the housing, or quarter width shelves on both sides of the housing.

The user also has the option of mounting a full width shelf 32 (FIG. 1) which has the capacity to hold numerous items which can be as large as the full width of the cabinet housing. A single full width shelf, as opposed to two shelves with a complimentary width of the housing as mentioned above, is stronger and able to support more weight. The user can create a large rectangular or square shaped cabinet space that spans the full width and much of the height of the cabinet, by mounting full width shelves near only the top and bottom of the housing.

Figure 5:
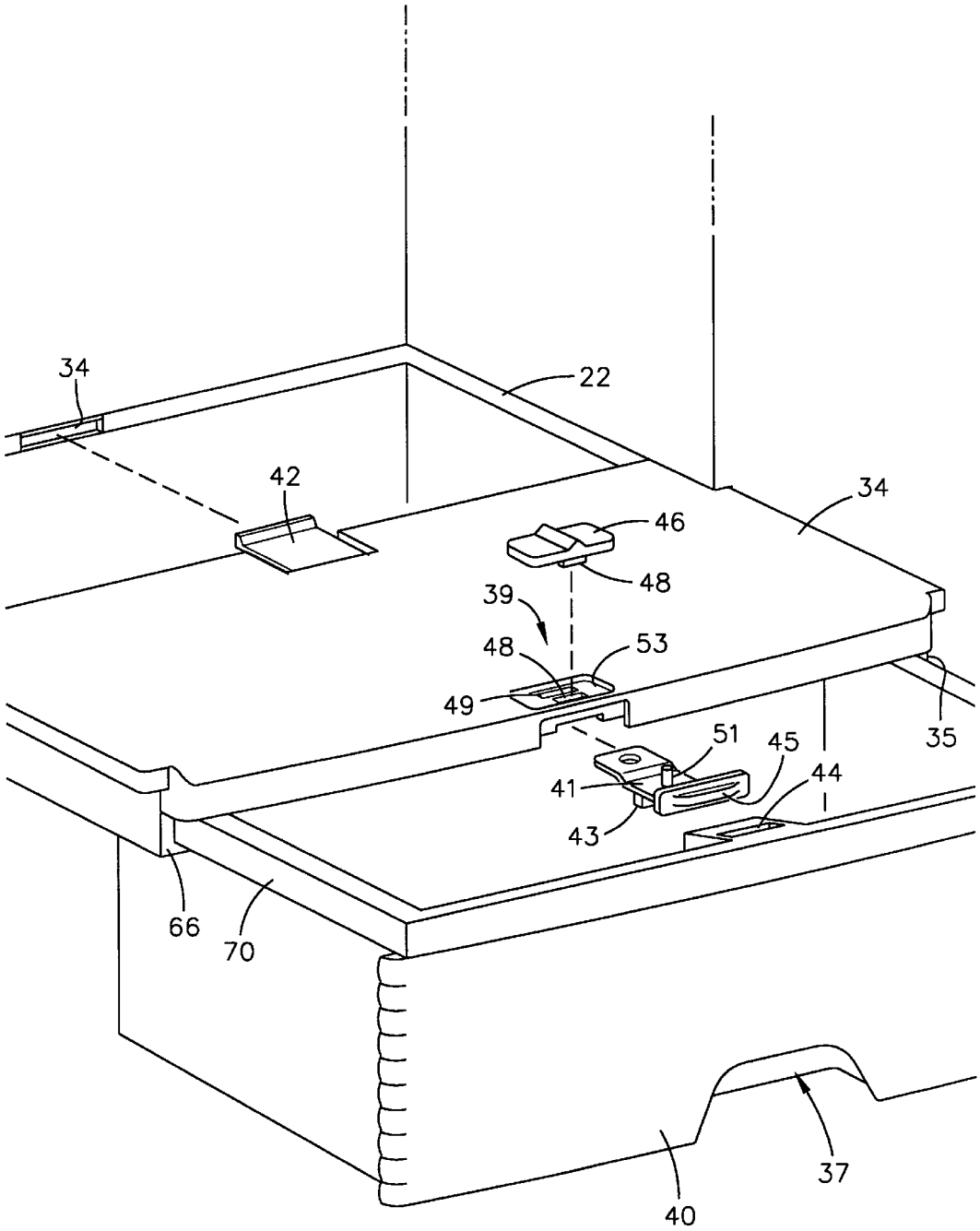
FIG. 5 is an enlarged perspective view of one embodiment of the drawer storage with an exploded view of the lock.

Referring to FIG. 5, one of the shelf units 34 has provision in the form of a pair of rails 66 and 68 on the underside for slidably mounting a drawer 36. The shelf and drawer are shown half width but may be any desirable width up to the full width of the cabinet. The drawer may also have a depth or height greater than that of the distance between two vertically spaced mounting grooves as illustrated. A hand hold 37 for grasping and opening and closing the drawer is formed in the lower front of the drawer. The drawer is preferably equipped with a child resistant lock 39.

Figure 6:
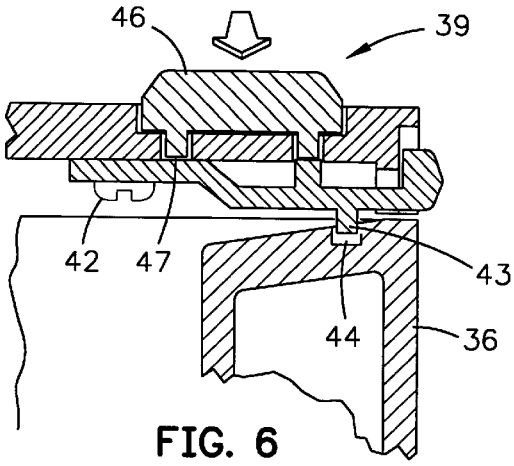
FIG. 6 is an enlarged sectional view of the of the drawer lock in the locked position.
Figure 7:
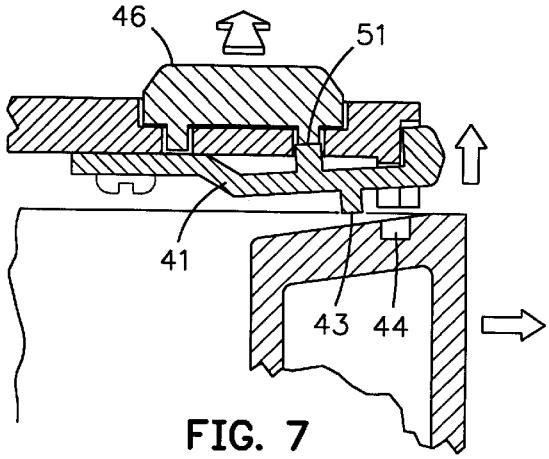
FIG. 7 is an enlarged sectional view of the of the drawer lock in the unlocked position.

The lock 39 as shown in FIGS. 5–7 comprises an elastic latch arm 41 secured by a screw or the like 42 to the underside of shelf 34 The latch arm has a lug 43 that is normally biased into engagement with locking depression 44 in a top portion of drawer 40 a finger or thumb tab 45 is formed on the front of the latch arm to enable lifting the latch arm as in FIG. 7 to release the drawer. A locking slide or button 46 has a guide bar 47 and cam 48 that extend into slots 9 and 49 in recess 50 in the top of shelf 34. The slide 46 moveable back and forth in the slot or recess 50 so that cam 48 engages pin 51 to selectively cam the latch arm as in FIG. 6 or release it as in FIG. 7. The lock, when the slide is used, requires two separate actions to unlock it and is therefore child resistant. The user has the option of using or not using the slide.

Figure 8:
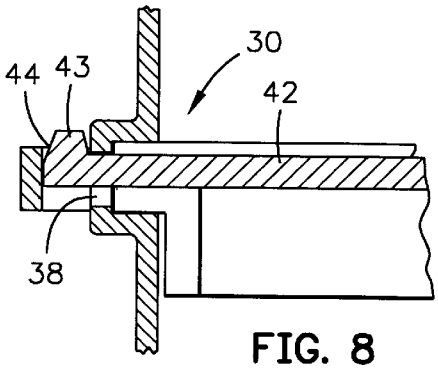
FIG. 8 is an enlarged sectional view of the of the shelf and mounting groove and groove latch in the latched position.
Figure 9:
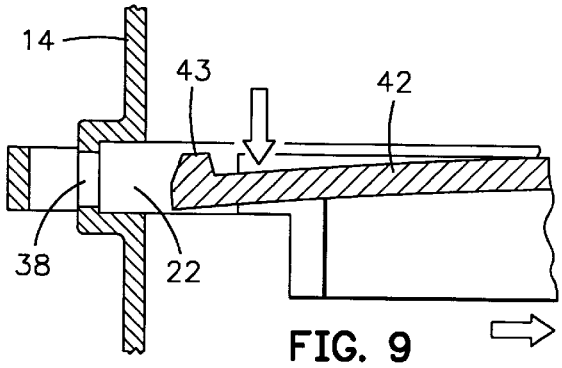
FIG. 9 is an enlarged sectional view of the of the shelf and mounting groove and groove latch in the unlatched position.

Referring to FIGS. 5, 8 and 9, a storage unit latching device 30 comprises a horizontal latch slot 38 (FIG. 3) cut through a back wall of the mounting groove 22, into which a storage unit latching tab 42 formed on the back of the shelf unit 34 is inserted for securing the storage unit into the mounting groove. The latch tab 42 has a lug 43 forming a shoulder which engages the back wall of the mounting groove to latch the unit 34 in the groove. A cam surface 44 is formed on the lug 43 to cam the latch tab down while inserting it into the latching slot 38. The tab is pressed down by a finger or other object to release it to enable the shelf to be removed from the groove.

Other embodiments may use a differently designed latching devices, suitable for securing storage units and shelves to the housing. For instance, there may be a tab on the housing which engages a groove on the storage unit, or units may be secured using a screw or glue for permanent mounting. Alternatively, clips may be mounted on the front edges of the housing side walls which clip the storage units in place in a similar fashion to those used in electronic devices to secure circuit cards into a housing. If desired, a housing and or storage units may contain or implement a combination of latching techniques.

The components of a storage unit latching device 30 are preferably formed as part of the housing 12 and storage unit during injection molding. However, any other suitable alternative means during or after manufacture of the housing or storage unit may be used for producing a latching device. Therefore, the housing component of a storage unit latching device 30 is preferably formed as part of the housing 12 during its injection molding manufacture, but may be adequately formed by other means such as being cut through mounting grooves at specific locations after housing manufacture.

Referring to FIG. 10, an exemplary preferred construction of a shelf unit 24 is illustrated. The shelf unit is preferably molded of a suitable plastic as previously explained is made thin and light with reinforcing ribs. The unit is formed with a mounting tongue 26 extending outward from the sides and back of the shelf unit for extending into a mounting groove. A peripheral reinforcing rib 52 extends downward from the lower surface of the shelf unit and around the entire periphery thereof. A pair of spaced parallel ribs 54 and 56 extend between the front and back portions of rib 52 parallel to and spaced inward from the ends. A pair of cross ribs 58 and 60 extend across the center of the bottom of the shelf and join the peripheral rib where the two parallel ribs join thereto. These ribs are preferably of a thickness and depth to make the shelf unit sufficiently stiff and rigid that an outer unsupported corner can support the usual articles without undue sagging or deflection. Additional ribs may be employed if desirable and the cross ribs may also extend to the corners of the shelf unit.

Figure 11:
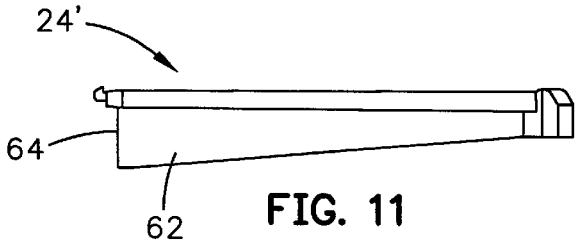
FIG. 11 is a side elevation view of an alternate embodiment of the half length shelf unit.

An alternate embodiment of a shelf unit is illustrated in FIG. 11 and designated generally by the numeral; 24'. This embodiment illustrates a modification which provides additional stiffness or rigidity and support to the shelf unit. In this embodiment the end ribs (only one shown 62) are made deeper at the rear and tapers to a shallower depth or height at the front. The rib portion 64 at the back edge of the shelf unit may also be deeper. This construction may apply to some or all of the ribs on the bottom surface of the shelf units.

Figure 12:
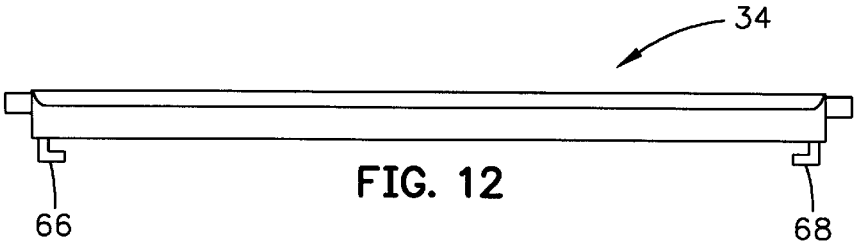
FIG. 12 is a front elevation view of the view of the shelf unit with tracks for supporting a drawer unit.

A shelf unit 34 for supporting a drawer is illustrated in FIG. 12 wherein a pair of rails 66 and 68 are shown depending from the lower surface of the unit near the side edges. The drawer is equipped with a slide or runner such as shown at 70 in FIG. 5 for supporting the drawer for sliding in the rails. The shelf unit 34 is similar in construction to that of 24 and 24' and may be reinforced in the same or a similar manner.

Figure 13:
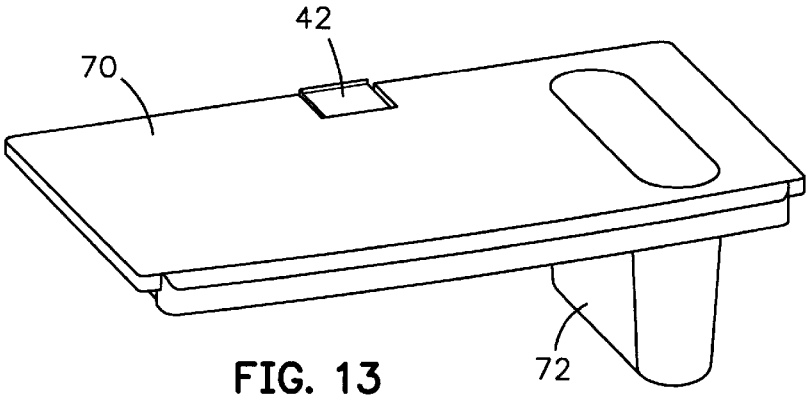
FIG. 13 is a perspective view of the front of the half length shelf unit with a storage receptacle.
Figure 14:
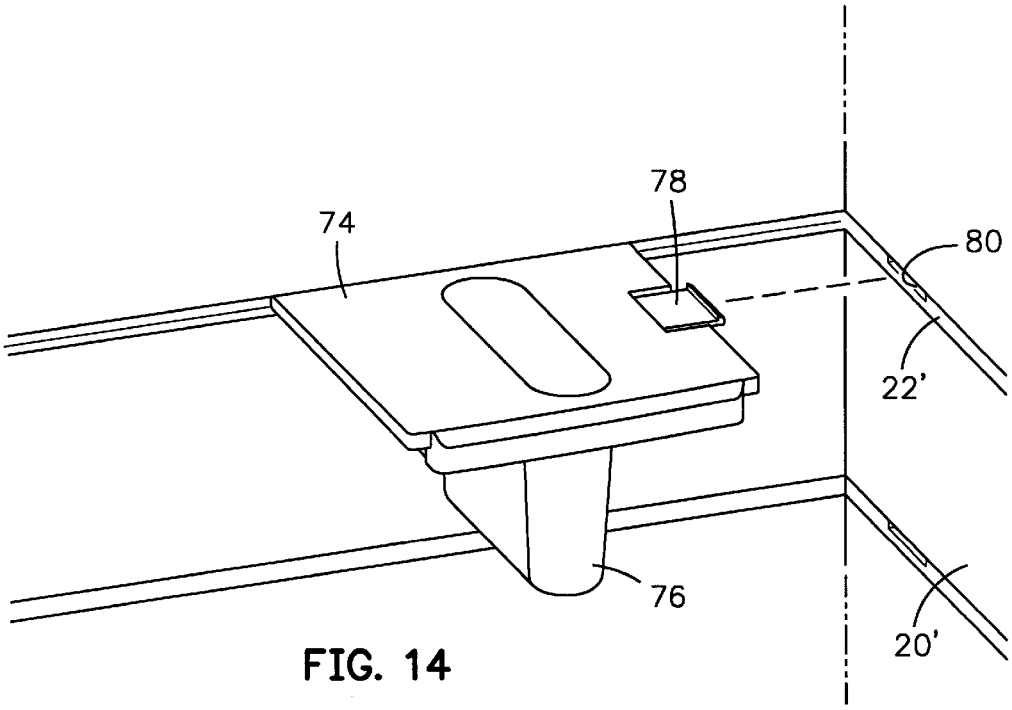
FIG. 14 is a perspective view of the front of the quarter length shelf unit with a storage receptacle.

Additional embodiments of the storage units may be provided such as that illustrated in FIGS. 13 and 14 wherein wells may be formed in the shelf unit. As illustrated in FIG. 13, a shelf unit 70 of the same general size and configuration as units 24 or 24' is provided with a open top receptacle 72 to receive and hold items such as tooth brushes and the like. In the illustrated embodiment only one receptacle is shown at one side of the shelf, however several receptacles of different sizes and shapes may be provided. In addition the receptacle or receptacles may be positioned in any number of different locations on or in the shelf unit.

Referring to FIG. 14, a further embodiment is illustrated wherein a shelf unit 74 of about one quarter width or at least a width considerably less than half width of the cabinet is provided with a receptacle at proximate the center thereof The shelf unit employs the same or similar construction as the earlier described shelves. However, the unit is provided with a latching device at the side with a tab 78 for engaging a latching slot 80 in a slot 22' in a side wall 20'.

The variety of storage units which may be installed in the cabinet is extensive. Those illustrated and described are just a few examples. For instance, it is possible to mount units with various widths, sizing from a very narrow shelf which might have a single hole or receptacle to support a toothbrush to a full cabinet width shelf capable of holding numerous items. Half width storage units may be mounted on only one side of the housing as shown in FIG. 14 or quarter width units may be mounted on both sides of the housing, affording the user a large full cabinet height column of space the width of half the cabinet for storing items as tall as the cabinet interior. Optionally, full width storage units may be mounted on only a few of the top and bottom mounting grooves, affording the user a large full cabinet width space the height of much of the cabinet for storing items as wide as the cabinet interior.

Similarly, it is possible to mount a variety of different types of storage units including but not limited to: a shelf underneath which is mounted a tilt out drawer (not shown), a shelf with a storage receptacle having bins in the shape of an egg crate. When installed the back edge and tapered supporting side edges of these storage units or shelves mount flush against the housing back wall for additional support. Alternative modifications include ribbing with a profile tapering from the storage unit back edge to its front edge, which may be used alone or in conjunction with the tapering side edges, for additional support. Similar to the side edges configuration above, the reinforcing tapered ribbing mounts flush against the back wall of the housing for additional support.

As best shown in FIG. 1, a door designated generally at 82 is pivotally mounted to the storage cabinet housing by suitable hinges 84. The components of the hinges may be molded with the respective housing and door as they are molded. The hinge is constructed in the usual manner with overlapping lugs on the housing and the door with aligned bores in which a hinge pin (not shown) is inserted. The hinge pin is preferably removable to enable removal and replacement of the door. Preferably, the door is constructed of a molded door back with the hinge elements molded in place, a mirror 88 is mounted on the inside and a mirror (not shown) is mounted on the outside surface of the door. A seal, not shown is preferably mounted between the housing and the door to reduce the noise and shock resulting when the door is closed. Alternate embodiments include a door back with a flat sheet plastic back, a door with half of the hinge components attached to it with fasteners so that the door may be secured to the housing using a hinge pin, a door having a molded door back with door hinge elements molded in place on it, and a door with mirrors mounted on its outside and inside surfaces.

In the preferred embodiment, the door hinges have pins (not shown) that my be removed allowing door replacement without taking the housing from the wall. The preferred hinges allow the door to open up to a 120 degree angle, however, other suitable hinges may be employed.

The door hinges may have some components integral to the body of the housing 12 and the other components on or in the door 82 wall hinges may have some components integral to the body of the housing 12 and the other components molded integrally to the door 82, or alternatively the door hinges may have components attached to the housing and door back (not shown) with fasteners.

The preferred door is constructed using the same plastic as that of the housing. In an alternative embodiment, a door may be constructed of other suitable materials such as metal, plastic, aluminum, wood or a combination of such materials. In another embodiment, the door is constructed of an easy to clean material selected to minimize static electricity buildup, thereby minimizing dust residue in the cabinet.

A door latching mechanism is used to latch the door to the housing in a closed position. In the illustrated embodiment (FIG. 1) the door latch mechanism is composed of a door mounted striker plate component 88 and a housing mounted magnet component 90 (the latching mechanism preferably has the housing mounted magnet covered in plastic, having enough magnetic pull to provide a solid close when engaging a metal striker plate on the door. The purpose of this configuration is for the magnet to engage the striker without the typical noise (clicking sound) associated with traditional magnetic closures. Another way of achieving this goal is to use a housing mounted magnet enclosed and hidden by a separate plastic part for engaging a metal section of the door. Other suitable door latch mechanisms may be used including door mounted components that go through an opening in the housing and latch in hook-like manner.

While we have illustrated and described our invention by means of specific embodiments, it is to be understood that the scope of the invention is to be limited only by the appended claims. CLAIMS

What is claimed is:

1. A storage cabinet, comprising:

a generally rectangular open front housing having a rear wall joined to a top wall, bottom wall, and side walls;

a plurality of mounting grooves, each groove extending horizontally along the inside back wall and side walls of said housing;

a plurality of storage units having mounting edges adapted to be selectively mounted in said housing in selected ones of said mounting grooves;

at least one latching device for latching each of said storage units in one of said mounting grooves; and wherein at least one of said storage units is supported solely by said storage unit mounting edges engaging one of said mounting grooves along a portion of said back wall and one of said side walls.

2. The apparatus according to claim 1, wherein said storage units have a variety of widths.

3. The apparatus according to claim 2, wherein at least one of said storage units is as wide as the full width of the interior of said housing.

4. The apparatus according to claim 1, wherein at least one of said storage units spans half the full width of said housing and is supported solely by said storage unit mounting edges engaging one of said mounting grooves along a portion of said back wall and one of said side walls.

5. The apparatus according to claim 1, wherein at least one of said storage units spans less than half the full width of said housing and is supported solely by said storage unit mounting edges engaging one of said mounting grooves along a portion of said back wall and one of said side walls.

6. The apparatus according to claim 1, wherein at least one of said storage units is a shelf with rails underneath which a drawer may be slidably mounted.

7. The apparatus according to claim 1, wherein at least one of said storage units is a shelf having rails on the undersurface and a drawer for moving slidably between inner closed and outer open positions.

8. The apparatus according to claim 7, wherein the drawer has a child resistant locking mechanism.

9. The apparatus according to claim 7, wherein the drawer has a user selectable single step lock mechanism or a double step child resistant lock mechanism.

10. The apparatus according to claim 1, wherein at least one of said storage units is constructed with ribbing in a cross configuration.

11. The apparatus according to claim 1, wherein at least one of said storage units is a shelf having a storage receptacle.

12. The apparatus according to claim 1 wherein at least one of said storage units has a back edge for engaging said housing back wall, an opposing front edge, and supporting side edges tapering from the back edge to the front edge, and wherein said storage unit back edge and supporting side edges mount flush against said housing back wall for additional support.

13. The apparatus according to claim 1, wherein at least one of said storage units has a back edge for engaging said housing back wall, an opposing front edge, and supporting side edges tapering from the back edge to the front edge, and wherein said storage unit back edge and supporting side edges mount flush against said housing back wall for additional support of said storage unit.

14. The apparatus according to claim 1, wherein said housing is constructed of material selected from the group consisting of metal, plastic, aluminum, wood, and material selected to minimizes static electricity buildup.

15. The apparatus according to claim 1, wherein:

(a) at least one of said storage unit latching devices further comprises of a latch receptacle in each of said mounting grooves for securing said storage unit; and (b) wherein at least one of said storage unit latching devices further comprises a latching tab for engaging said latch receptacle securing said storage unit in said mounting groove.

16. The apparatus according to claim 1, further comprising:

(a) a door and a door latching mechanism for latching said door to said housing in a closed position, wherein said door latching mechanism components are mounted on said door and said housing;

(b) said door latching mechanism is a magnet covered in plastic having enough magnetic pull to provide a solid close when engaging a metal striker plate on said door, but engaging said striker without the noise associated with traditional magnetic closures; and said door latching mechanism is a magnet enclosed and hidden by a separate plastic part.

17. The apparatus according to claim 16, wherein said housing is manufactured using a molding process.

18. A storage cabinet, comprising:

a unitary generally rectangular open front housing having top wall, bottom wall, and side walls joined to a rear wall;

a plurality of uniform vertically spaced mounting grooves, each groove extending horizontally along the inside back wall and side walls of said housing;

a plurality of storage units having a variety of widths, each unit having a mounting tongue extending along a back and side edges, the tongue adapted to selectively engage said mounting grooves and mount selected ones of said storage units in said housing;

at least one of said storage units having a width less than the full width of the interior of said housing;

at least one latching device for latching each of said storage units in one of said mounting grooves;

wherein said at least one of said storage units is supported solely by said storage unit mounting edges engaging one of said mounting grooves along a portion of said back wall and one of said side walls.

19. The apparatus according to claim 18, wherein at least one of said storage units is a shelf having rails on the undersurface and a drawer mounted on said rails for moving between inner closed and outer open positions.

20. The apparatus according to claim 19, wherein the drawer has a child resistant locking mechanism.

21. The apparatus according to claim 19, wherein the drawer has a user selectable single step lock mechanism or a double step child resistant lock mechanism.

22. The apparatus according to claim 18, wherein at least one of said shelf storage units is constructed with reinforcing ribbing in a cross configuration.

23. The apparatus according to claim 18, wherein at least one of said storage units is a shelf having a storage receptacle.

24. The apparatus according to claim 18, wherein at least one of said storage units is a shelf with rails underneath in which a drawer may be slidably mounted.

25. The apparatus according to claim 18, wherein said housing is manufactured using a molding process.

26. The apparatus according to claim 18, wherein:

(a) at least one of said storage unit latching devices further comprises a latch receptacle in each of said mounting grooves for securing said storage unit; and (b) wherein at least one of said storage unit latching devices further comprises a latching tab for engaging said latch receptacle securing said storage unit in said mounting groove.

27. The apparatus according to claim 18, further comprising:

(a) a door and a door latching mechanism for latching said door in a closed position, wherein said door latching mechanism components are mounted on said door and said housing; and (b) said door latching mechanism is a magnet covered in plastic in order to reduce the noise associated with traditional magnetic closures, the magnet having sufficient magnetic pull to provide a solid close when engaging a metal striker plate on said door.

* * * * *